United States Patent [19]

Pappas

[11] 4,309,065

[45] Jan. 5, 1982

[54] SECURITY ENCLOSURE FOR HANDGUNS

[76] Inventor: Peter R. Pappas, 1201 Sesame Dr., Sunnyvale, Calif. 94087

[21] Appl. No.: 30,235

[22] Filed: Apr. 16, 1979

[51] Int. Cl.[3] ..... A47B 81/00; E05B 65/46

[52] U.S. Cl. ..... 312/319; 224/912; 312/242; 312/245

[58] Field of Search ..... 312/197, 279, 305, 245, 312/319, 242, 296; 224/273, 282, 911, 912, 42.46 R, 42.45 R; 211/64; 248/314, 551, 552, 553; 109/68

[56] References Cited

U.S. PATENT DOCUMENTS

| | | | |
|---|---|---|---|
| 2,840,437 | 6/1958 | Cohen | 312/319 |
| 3,031,069 | 4/1962 | Hirsch | 211/64 X |
| 3,099,150 | 7/1963 | Check | 70/133 X |
| 3,419,728 | 12/1968 | Wilson | 224/912 |
| 3,447,850 | 6/1969 | Samson | 312/296 |
| 3,464,606 | 9/1969 | Nordeen | 312/242 X |
| 3,669,336 | 6/1972 | Robinson | 206/317 |
| 3,731,818 | 5/1973 | Young | 206/317 |
| 4,155,608 | 5/1979 | Orlewicz | 211/64 X |
| 4,155,610 | 5/1979 | Englund | 312/319 |

*Primary Examiner*—James T. McCall
*Attorney, Agent, or Firm*—Claude A. S. Hamrick

[57] ABSTRACT

A security closure for handguns including a rigid metal box having a front opening with a door pivotally attached to one side thereof and having a push-button combination locking mechanism. Disposed within the enclosure is a holster or other gun-holding receptacle which is pivotally mounted to the inside of the box and is adapted to swing outwardly as the door is opened so as to present the handle of the gun to one opening the door.

10 Claims, 4 Drawing Figures

SECURITY ENCLOSURE FOR HANDGUNS

BACKGROUND OF THE INVENTION

1. Field of the Invention

The present invention relates generally to firearm storage apparatus and more particularly to a security closure for handguns which can be quickly opened for withdrawal of the gun.

2. Description of the Prior Art

While the need for a handgun in an emergency situation requires that it be easily accessible, it is also well recognized that means must be provided to limit access to those for whom its use is not intended. Although lockable gun cases and cabinets have long been available for the storage of handguns and several such devices are disclosed in the U.S. Pat. Nos. to Pachmayr, 3,329,278; Young, 3,731,818; Robertson, 3,762,789; and Berens, 3,848,940, the problems with such prior art devices is that they are either not intended to have a high level of security or their security features make intended access to the weapon difficult.

SUMMARY OF THE PRESENT INVENTION

It is therefore an object of the present invention to provide a novel gun storage enclosure having a high degree of security but at the same time has features which make the contained weapon easily and quickly accessible to those having intended to have possession.

Briefly, a preferred embodiment of the present invention includes a rigid metal box having a front opening with a door pivotally attached along one side thereof and which includes a push-button combination locking mechanism. Disposed within the enclosure is a holster or other gun-holding receptacle or apparatus which is pivotally mounted to the inside of the box and is adapted to swing outwardly as the door is opened, and to present the handle of the gun to one opening the door.

An important advantage of the present invention is that even though highly secure when locked, the enclosure may be quickly opened with one hand and the gun may be easily and quickly removed from its holder.

These and other objects and advantages of the present invention will no doubt become apparent to those skilled in the art after having read the following detailed description of the preferred embodiments which are shown in the several figures of the drawing.

IN THE DRAWING

DETAILED DESCRIPTION OF THE PREFERRED EMBODIMENT

Figure 1:
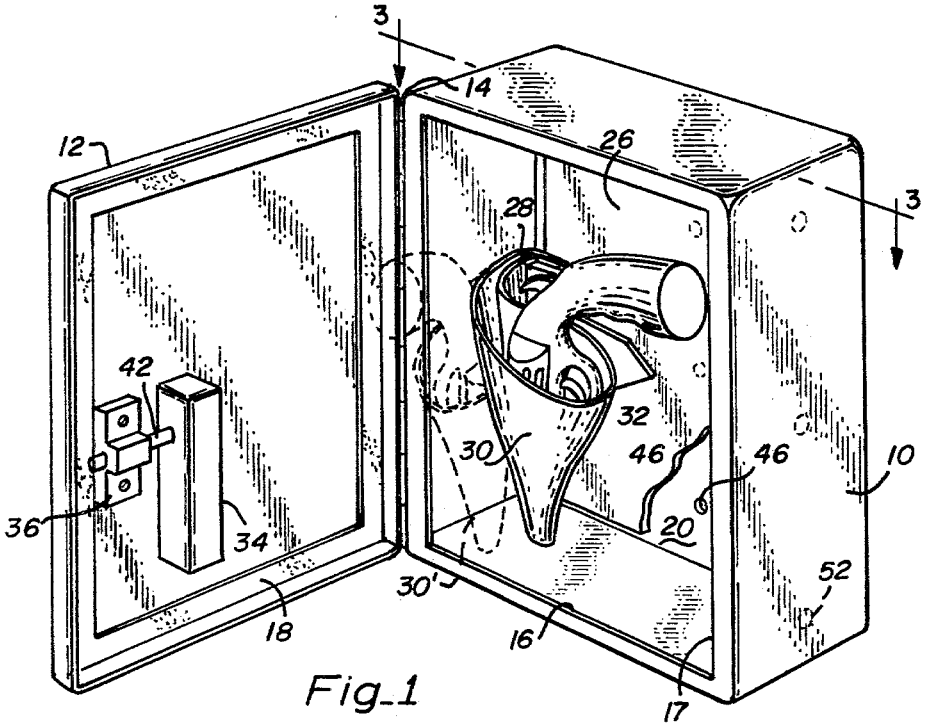
FIG. 1 is a perspective view showing a preferred embodiment of the present invention with the door in its opened position.

Referring now to FIG. 1 of the drawing, a preferred embodiment of the present invention is shown to include a single-piece, five-sided, rectangular metal box 10 having a metal door 12 attached to one side thereof by a piano-type hinge 14. The front edges of the walls of the box 10 are all folded inwardly, both to strengthen the side walls and to provide a sealing surface which mates with a resilient gasket 18 carried by door 12, thereby making the box dust proof when in its closed configuration.

Mounted to the inside back surface 20 by screws 24 and spaced therefrom by standoffs 22 (see FIG. 3) is a mounting plate 26. Affixed to the mounting plate is a vertically disposed bar 28 which serves as a means for attaching a leather or plastic holster 30 to the plate 26. The bar 28 also serves as a means for securing one end of a leaf spring 32 to the back plate 26. As may be noted in FIG. 3, the leaf spring 32 is deformed in cantilevered fashion so as to resiliently urge the holster toward the extended position shown by the dashed lines 30' when not held in its retracted position by door 12.

Figure 2:
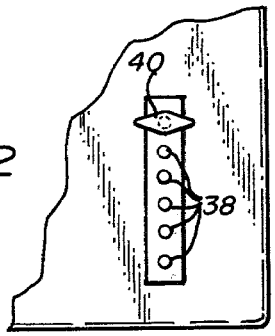
FIG. 2 is a broken front view illustrating the push-button combination locking feature of the embodiment shown in FIG. 1.

The door 12 is locked to box 10 by means of a commercially available push-button combination locking mechanism 34 and its associated bolt mechanism 36. As shown in FIG. 2, the mechanism 34 includes five push buttons 38 which when depressed in a predetermined combination allow the latch handle 40 to be rotated to withdraw the bolt 42 from its locked position behind the edge of box flange 17.

Figure 3:
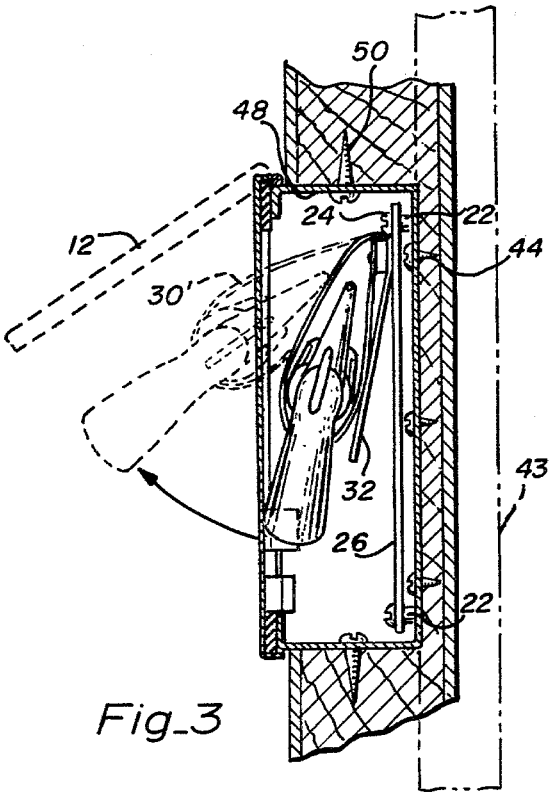
FIG. 3 is a cross section taken along the line 3—3 of FIG. 1.

The box may be either mounted to a flat wall surface such as is indicated by the dashed lines 43 in FIG. 3, and affixed thereto by means of screws or bolts 44 which are passed through holes 46 in the back wall of box 10, or may be mounted within a recess in a wall as indicated at 48 and secured to the sides of the recess by screws 50 which are passed through optional openings provided in the side walls (FIG. 3) and indicated by the dashed lines 52 in FIG. 1.

In operation, with the door 12 open, the holster 30 would be rotated into the outwardly extending position illustrated by the dashed lines 30'. With the holster 30 in this position, a handgun may be easily inserted thereinto. Once the gun is so positioned, one need simply rotate the door into the closed position and lock it in place. As is clearly apparent from the drawing, rotation of the door causes the inside surface thereof to engage either the gun butt or the side of holster 30 and cause it to rotate inwardly against the force of spring 32 into the position illustrated in FIGS. 1 and 3. Note that since spring 32 tends to bias the holster and gun outwardly against door 12, upon rotation of the locking knob 40 door 12 will release the latch and allow it to be rotated into its open position.

Figure 4:
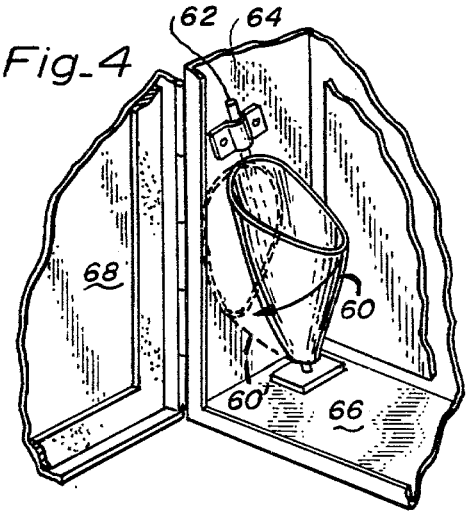
FIG. 4 is a broken partial perspective view showing an alternative embodiment in accordance with the present invention.

Turning now to FIG. 4 of the drawing, there is shown an alternative embodiment of the present invention in which no biasing spring is required, and in which instead, rotation of the holster 60 into the extended position illustrated by the dashed lines 60' is accomplished by mounting the holster to an inclined pivoting shaft 62 which is affixed at one end to side wall 64 and at the other end to the bottom wall 66. With the holster so mounted, the weight of the gun will cause the holster 60 to swing into the extended position 60' as the door 58 is opened.

Although only two embodiments of the present invention have been disclosed above and both utilize conventional holster-type receptacles for the gun, it is contemplated that other alternative means might also be used for holding the gun either in the position illustrated or in a more horizontally disposed position. For example, one might utilize a simple shaft that extends up the barrel of the pistol and is pivotally attached to the box so as to allow the pistol to rotate into the extended position, or perhaps one might utilize a similar tubular receptacle that receives only the barrel of the pistol. This invention is therefore deemed to include any type of pivotable gun holder which is adapted to swing from a position within the box 10 to an extended position as the door is opened. And whereas other alterations and modifications of the present invention will no doubt become apparent to those skilled in the art after having read this disclosure, it is intended that the appended claims be interpreted as covering all such alterations and modifications as fall within the true spirit and scope of the invention.

What is claimed is:

1. A security enclosure for handguns comprising:

a rigid rectangular box having a front opening;

a rigid door pivotally attached to one side of said box and pivotable between an open position allowing access to the interior of said box and a closed position closing said box;

locking means for locking said door in said closed position;

gun-holding means pivotally affixed to the interior of said box and adapted to swing independent of said door between a retracted position wherein the holding means and the held gun are located within the confines of the box and an extended position wherein at least the handle of the gun is caused to extend through said first opening; and means for causing said gun-holding means to swing from said retracted position when said door is closed to said extended position as said door is opened.

2. A security enclosure as recited in claim 1 wherein said holding means is a flexible holster, one side of which is attached to an inside wall of said box.

3. A security enclosure as recited in claims 1 or 2 wherein said means for causing said gun-holding means to swing is a resilient member resiliently urging said holding means toward said extended position.

4. A security enclosure as recited in claim 3 wherein said resilient member is a leaf spring having one end portion affixed to said box and another end portion engaging said holding means.

5. A security enclosure as recited in claim 1 wherein said locking means is a combination lock.

6. A security enclosure as recited in claim 5 wherein said combination lock is a push-button combination device.

7. A security enclosure as recited in claim 1 wherein the front edges of the side walls of said box are turned inwardly to form a sealing surface and wherein said door has a resilient gasket which engages said front edges to form a seal for keeping dust out of said closure.

8. A security enclosure as recited in claim 1 wherein said means for causing said holding means to swing is a pivot means attached to an inside wall of said box and having an axis that is inclined relative to a vertical wall of said box whereby gravitational forces tend to cause said holding means to rotate about said axis.

9. A security enclosure as recited in claim 8 wherein the upper extremity of said pivot means is disposed closer to said opening than is the lower extremity thereof.

10. A security enclosure as recited in claims 8 or 9 wherein said holding means is a flexible holster, one side of which is attached to said box by said pivot means.

* * * * *